US005236107A

United States Patent [19]

Spaanstra, Sr.

[11] Patent Number: 5,236,107

[45] Date of Patent: Aug. 17, 1993

[54] DISPENSING CAP CONSTRUCTION

[75] Inventor: Lambert Spaanstra, Sr., Hackettstown, N.J.

[73] Assignee: Stull Closure Technologies, Inc., Randolph, N.J.

[21] Appl. No.: 947,838

[22] Filed: Sep. 21, 1992

[51] Int. Cl.[5] ..... B67D 3/00; B65D 47/08

[52] U.S. Cl. ..... 222/534; 222/536; 222/556; 222/517; 215/235; 215/237; 220/254; 220/281

[58] Field of Search ..... 215/237, 235, 238; 220/254, 259, 281, 282, 343; 222/517, 534, 531, 556, 536

[56] References Cited

U.S. PATENT DOCUMENTS

| | | | |
|---|---|---|---|
| 4,487,342 | 12/1984 | Shy | 222/481.5 |
| 4,776,501 | 10/1988 | Ostrowsky | 222/517 |
| 4,962,869 | 10/1990 | Gross et al. | 222/153 |
| 4,982,882 | 1/1991 | Gueret | 222/531 |
| 5,022,566 | 6/1991 | Song et al. | 222/480 |
| 5,054,662 | 10/1991 | Santagiuliana | 222/531 |
| 5,065,912 | 11/1991 | Rosenthal | 222/517 |
| 5,123,561 | 6/1992 | Gross | 220/254 |

*Primary Examiner*—Allan N. Shoap
*Assistant Examiner*—Vanessa Caretto
*Attorney, Agent, or Firm*—H. Gibner Lehmann; K. Gibner Lehmann

[57] ABSTRACT

A dispensing cap construction having a closure button which is pivotally mounted in the upper portion of a tubular cap body. The closure button and the cap body have communicating discharge passages, and the button has an orifice at the end of its discharge passage. The button orifice is normally closed by the upper wall of the cap body, and such wall is resilient and has a bulge which extends into the button orifice to act as a detent thereby to minimize the likelihood of the botton becoming inadvertently opened.

9 Claims, 1 Drawing Sheet

DISPENSING CAP CONSTRUCTION

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to dispensing cap constructions adapted for attachment to containers such as hand-held bottles, cans and the like, and more particularly to the detent means intended to maintain the openable parts of dispenser caps in their closed, storage positions.

2. Description of the Related Art Including Information Disclosed Under 37 CFR §§1.97-1.99

In the past various types of press-to-open caps have been proposed and produced, wherein a pivotally-mounted closure button was depressed at one area on its face or top so as to raise another area of the button and open the discharge passage which contained the discharge orifice, thereby to place the container in readiness for use. These caps were satisfactory in general, but at times the closure button would for some reason or other be inadvertently opened or partially opened, causing leakage and rendering the product unsuitable.

The detent means commonly employed in these prior caps involved a small detent projection or nib provided on the closure button, which projected into the space defined by the finger notch of the cap body. When the button was being depressed, that portion which carried the detent nib would be forced downward against the restraint provided by the lower edge of the finger notch, and the finger pressure combined with the reactive forces at the pivot for the button, being stronger than the restraint on the nib, would force the nib past the finger notch with the continuing movement of the button. The cap body was yieldable at the finger notch, to enable such bypass of the detent nib.

However, the pivotal mounting for the button was not of an absolutely positive nature, and the button could be forced from the cap body by overcoming the pivots. When this occurred, as by accident for instance, the restraint represented by the detent nib on the button, was no longer effective. This type of restraint involved a kind of lever action in which the pivots participated, and if the pivots ceased to function properly the lever action ceased and the restraint no longer existed.

SUMMARY OF THE INVENTION

The above disadvantage and drawback of prior dispensing caps of this type is obviated by the present invention, and one object of the invention is to provide a novel and improved detent means in a dispensing cap construction, which is more reliable as regards inadvertent opening and leakage of the container contents.

Another object of the invention is to provide an improved detent construction as above set forth, which is especially simple and economical to incorporate in existing caps of the subject type.

A further object of the invention is to provide an improved detent means in accordance with the foregoing, which does not require appreciable changes in the existing tooling for the caps.

Still another object of the invention is to provide an improved dispensing cap construction as characterized, wherein reliance is not placed on the pivots for the button to obtain a detent action, but instead there is had a direct-acting abutment-type detent that is cooperable with the orifice structure of the button.

In accomplishing the above objects the invention provides an improved dispensing cap construction including a cap body having a discharge passage, said body being adapted for mounting on a container to dispense product therefrom through said passage. Pivotally mounted on the cap body is a closure button which has a discharge passage adapted to communicate with the passage of the cap body to receive the product to be dispensed, and has a discharge orifice at the end of its discharge passage. The cap body has a wall which is disposed opposite and juxtaposed to the button orifice when the button is in its closing position, such body wall constituting a cover for the orifice. The pivotal movement of the closure button to its dispensing position effects a lateral shifting of the orifice, and the body wall has a detent bulge which extends into said orifice and which normally tends to yieldably retain the closure button in its closing position.

Other features and advantages will hereinafter appear.

DESCRIPTION OF THE PREFERRED EMBODIMENT

Figure 1:
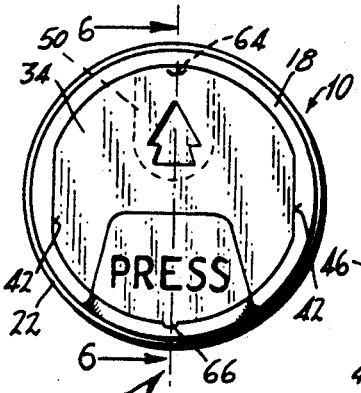
FIG. 1 is a top plan view of the improved dispensing cap construction of the invention.
Figure 4:
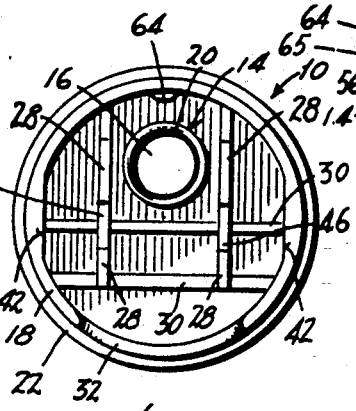
FIG. 4 is a top plan view of the body part of the cap construction.

Referring now to the drawings in detail, the improved cap construction comprises a cylindrical cap body 10 having, intermediate its ends a transverse wall 12 which mounts a product discharge conduit or discharge passage 14 that extends upward from an opening 16 in the wall 12 to a point just below the plane of the top rim 18 of the body. The upper end of the conduit 14 constituting a discharging end, has an internal bevel surface 20 to provide a seat for a stopper ring of the closure button described below.

The bottom end of the body 10 has an annular bead 22, and an internal thread 24 is provided in the lower body skirt portion to enable the body to be screwed onto the threaded neck of a container. A sealing lip 26 on the underside of the transverse wall 12 insures against leakage at the container neck (not shown).

The body 10 has strengthening ribs 28 and 30 which also serve important other functions described below.

As shown in various figures, the body 10 has a deep finger notch 32 in its upper wall portion, which provides finger clearance when the stop button of the cap is to be depressed.

Figure 7:
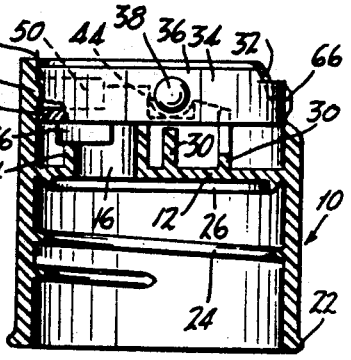
FIG. 7 is a partial vertical section partial side elevation of the cap construction, showing the closure button in side elevation and in its closed position.
Figure 5:
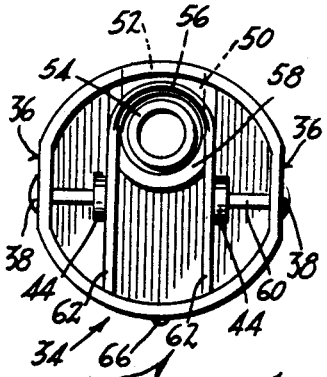
FIG. 5 is a bottom plan view of the closure button of the cap construction.
Figure 6:
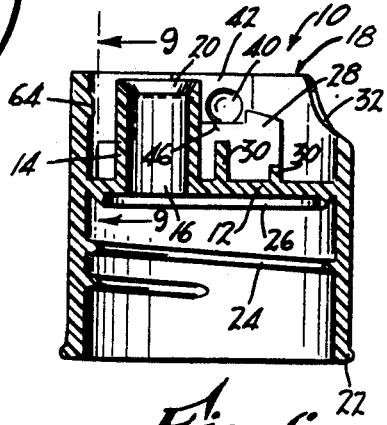
FIG. 6 is a diametric vertical section of the cap construction, taken on the line 6—6 of FIG. 1.

Pivotally carried by the body 10 is a closure depress button 34 which is in the form of a wafer-like shallow cup that closely fits into the top portion of the body and can be tilted while therein. The button 34 has a cylindrical exterior wall except for two oppositely disposed flats 36 which have bearing nibs or bosses 38 that fit into shallow bearing sockets 40 located in flats 42 in the body 10. The sockets 40 are hereinafter referred to in some of the claims as first sockets. The button 34 can be pivotally shifted about a pivotal axis between a horizontal or flat closing position shown in FIGS. 1, 2 and 7 to a tilted dispensing position shown in FIG. 8 about the bosses 38 as centers. The button 34 also has semi-cylindrical trunnions or trunnion portions 44 which rest in additional or second sockets 46 of the ribs 28, to provide additional pivotal support for the button 34, as seen in FIG. 7. When the button is in the tilted position of FIG. 8, the ribs 30 can act as stops, in addition to the bottom edge 48 (FIG. 8) engaging the transverse wall 12. As shown in FIGS. 5-7, the trunnions 44 and the second sockets 46 are in alignment with the bosses 38 and the first sockets 40.

Figure 8:
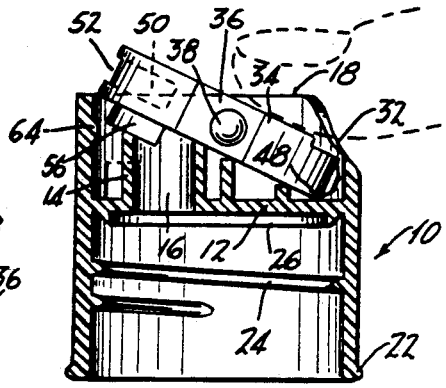
FIG. 8 is a view similar to that of FIG. 7 but showing the closure button pivoted to its dispensing position.
Figure 3:
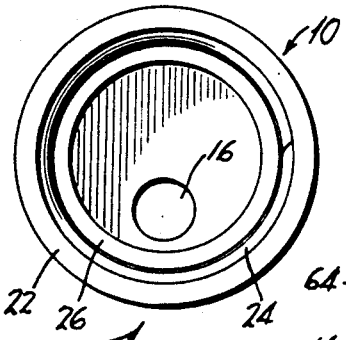
FIG. 3 is a bottom plan view of the cap construction.
Figure 9:
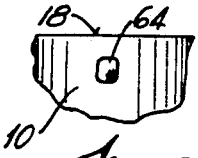
FIG. 9 is a fragmentary elevational view taken on the line 9—9 of FIG. 6.

The button 34 has a discharge passage 50 which exits at an orifice 52, see FIGS. 7 and 8. At the upper underside of the discharge passage 50 there is a stopper ring 54 which seats in the bevel 20 of the discharge conduit when the button is in its closed position, to close off the discharge passage of the conduit. With the button 34 raised as in FIG. 8, the ring 54 is raised from the seat 20, thereby to permit flow of product through the passages.

The button 34 also has a shield surrounding the top of the conduit, comprised of a low front shield portion 56 and a higher rear shield portion 58 to minimize leakage between the discharge passages of the body and button during the dispensing operation. Strengthening ribs 60 and 62 are seen in the underside of the button 34, to maintain its structural integrity.

Figure 2:
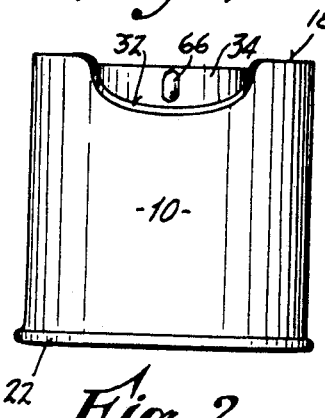
FIG. 2 is a front elevational view of the cap construction.

In accordance with the invention, improved detent means are provided to maintain the button 34 securely in its closed, sealing position seen in FIGS. 1 and 7. This detent means is in the form of a detent nib or bulge 64 formed on the inside surface of the upper wall of the body 10 so as to extend slightly into the orifice 52 of the button 34. The slight interlocking of the bulge 64 of this portion of the cap body wall with the edges of the orifice 52, especially the lower edge 65, has been found to be effective in preventing inadvertent opening or pivoting movement of the button from its closed position, thereby to prevent leakage and loss of product from the container with which the closure cap is used. The wall of the body 10 which has the bulge is resilient and can yield when finger pressure is applied to the button as indicated in FIG. 8. The bulge is seen to be closely adjacent the discharge passages of the cap and remote from the pivotal axis of the bearing bosses whereby its retainer action results in an improved restraint of the button 34 and resistance to leakage in the cap.

Also, in accordance with the invention, a cooperative relationship exists between a detent nib 66 provided on the button 34 diametrically opposite the bulge 64, such nib 66 being engageable with the lower edge of the finger notch 32 of the body and also serving to prevent inadvertent opening movement of the button. Both the bulge 64 and the nib 66 therefore give added assurance against leakage, since each serves to retain the button in its closing position.

An important feature of the invention resides in the improved construction wherein reliance is not placed solely on proper functioning of the pivot bosses 38 and the trunnions 44 to provide the detent action which minimizes the likelihood of the button becoming inadvertently opened. In prior devices such reliance existed, and often resulted in the buttons being at least partially opened, causing leakage.

Instead, with the present invention, the detent represented by the bulge 64 and the cooperable orifice lip 65 does not involve the pivotal bosses 38 nor the trunnions 44, but instead there is a direct abutment action between the parts 64 and 65, making for much greater dependability and reliability in the proper functioning of the cap.

It is to be further noted, that the cooperable lever-type detent action involving the pivots 38, trunnions 44 and the nib 66 at the finger notch 32 is still in effect, adding to the reliability of the closure in preventing inadvertent leakage.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A dispensing cap construction comprising, in combination:

a) a cap body having a discharge passage, said body being for mounting on a container to dispense product therefrom through said passage, b) a closure button pivotally mounted on the cap body, said button having a discharge passage in communication with the passage of the cap body to receive the product to be dispensed, and having a discharge orifice at one end of said discharge passage, said closure button having a dispensing position and a closing position, c) said cap body having a side wall a portion of which is disposed opposite and juxtaposed to the discharge orifice when the button is in said closing position, said wall constituting a cover for the orifice, d) pivotal movement of the closure button to said dispensing position effecting a lateral shifting of the orifice, and e) said wall portion having a detent bulge which extends into said orifice and which yieldably retains the closure button in said closing position.

2. A cap construction as set forth in claim 1, wherein:

a) said cap body having an upper portion the button being disposed within said upper portion of the body, b) said body having a pair of oppositely disposed first sockets in said wall, and c) said button having a pair of oppositely-disposed bearing bosses disposed within said first sockets.

3. A cap construction as set forth in claim 2, wherein:

a) the button has a pair of oppositely-disposed flats from which the bearing bosses protrude, b) said body having oppositely-disposed flats in said wall, in which said first sockets are disposed.

4. A cap construction as set forth in claim 1, wherein:

a) said discharge passage of the cap body has a discharging end, and said discharge passage of the cap body comprises a conduit provided with an internal bevel at said discharging end, b) said button having a sealing ring in said discharge passage, fitting into the bevel of the body to effect a seal therewith.

5. A cap construction as set forth in claim 4, wherein:

a) the button has a circular shield extending around the discharging end of the body conduit when the button is in the closing position.

6. A cap construction as set forth in claim 1, wherein:

a) said wall portion of the cap body is resilient and yieldable to enable the discharge orifice of the button to be forced past the bulge of the body wall when the button is being shifted to said dispensing position.

7. A cap construction as set forth in claim 1, wherein:

a) the cap body has a finger notch in said wall, and b) the button has a detent nib engageable with the finger notch, to retain the button in the closing position.

8. A cap construction as set forth in claim 2, wherein:

a) the button has oppositely-disposed trunnions, b) said body having oppositely-disposed second sockets in which the button trunnions are received and on which they bear, c) said trunnions and said second sockets being in alignment with said bosses and said first sockets.

9. A cap construction as set forth in claim 7, wherein:

a) the bulge on the wall portion of the body is oppositely disposed with respect to the detent nib of the button, and b) said closure button which is pivotally mounted on the cap body being movable about a pivotal axis thereon, said pivotal axis of the button being intermediate said bulge and detent nib.

* * * * *